US007556213B2

(12) United States Patent
Schwelling

(10) Patent No.: US 7,556,213 B2
(45) Date of Patent: Jul. 7, 2009

(54) DEVICE FOR COMMINUTING EMPTY CONTAINERS

(76) Inventor: Hermann Schwelling, Hartmannweg 5, D-88682 Salem (DE)

( * ) Notice: Subject to any disclaimer, the term of this patent is extended or adjusted under 35 U.S.C. 154(b) by 307 days.

(21) Appl. No.: 10/579,272

(22) PCT Filed: Nov. 12, 2004

(86) PCT No.: PCT/EP2004/012841

§ 371 (c)(1),
(2), (4) Date: May 12, 2006

(87) PCT Pub. No.: WO2005/046876

PCT Pub. Date: May 26, 2005

(65) Prior Publication Data

US 2007/0080251 A1 Apr. 12, 2007

(30) Foreign Application Priority Data

Nov. 13, 2003 (DE) ..... 103 53 188

(51) Int. Cl.
*B02C 18/16* (2006.01)

(52) U.S. Cl. ..... 241/99; 241/166; 241/236; 241/295

(58) Field of Classification Search ..... 241/99, 241/36, 236, 100, 166, 167
See application file for complete search history.

(56) References Cited

U.S. PATENT DOCUMENTS

| | | | | |
|---|---|---|---|---|
| 4,729,515 | A * | 3/1988 | Wagner | 241/99 |
| 4,923,126 | A * | 5/1990 | Lodovico et al. | 241/30 |
| 5,642,661 | A | 7/1997 | Tu | |

FOREIGN PATENT DOCUMENTS

| | | | |
|---|---|---|---|
| DE | 38 06 119 | A1 | 10/1988 |
| DE | 43 38 561 | A1 | 5/1995 |
| DE | 201 11 752 | U1 | 12/2001 |
| DE | 100 55 201 | A1 | 5/2002 |

* cited by examiner

*Primary Examiner*—Mark Rosenbaum
(74) *Attorney, Agent, or Firm*—Collard & Roe, PC

(57) ABSTRACT

The invention relates to a device for comminuting empty containers, particularly beverage bottles or cans made of plastic, particularly of PET or of tinplate, comprising a housing provided with a filling opening and with a discharge opening, and comprising a cutting unit mounted inside the housing and means for driving and controlling the cutting unit. The cutting unit contains at least two cutting rollers, which are mounted at a distance from one another with regard to their rotation axes, and the cutting mechanism containing the cutting rollers is a document shredder cutting mechanism.

19 Claims, 3 Drawing Sheets

DEVICE FOR COMMINUTING EMPTY CONTAINERS

CROSS REFERENCE TO RELATED APPLICATIONS

Figure 1:
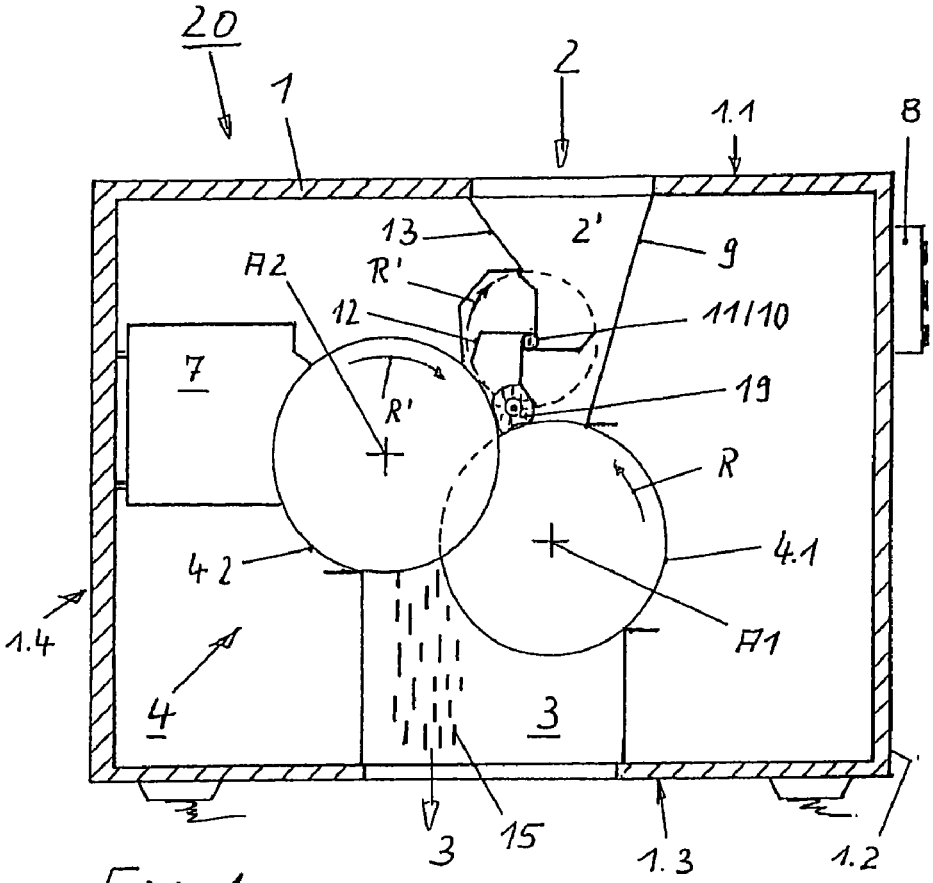

Applicant claims priority under 35 U.S.C. §119 of German Application No. 103 53 188.2 filed Nov. 13, 2003. Applicant also claims priority under 35 U.S.C. §365 of PCT/EP2004/012841 filed Nov. 12, 2004. The international application under PCT article 21(2) was not published in English.

The invention relates to a device for comminuting empty containers, particularly beverage bottles or cans, or similar waste made of plastic or thin-walled sheet metal, in accordance with the preamble of claim 1.

Such devices are used to reduce the volume of empty containers, particularly those from the foods sector, such as beverage bottles, cans, and similar containers, for transport to the recycling facilities or for the recycling process itself, and for their further processing.

For one thing, devices that work according to the principle of plate pressing are known, and for another, those whose pressing unit(s) contain rollers are known. These devices are optimized either for the treatment of plastic containers or of tin plate containers/cans.

Since the said waste goods can also contain closed containers, in a number that is not insignificant, the pressing device(s) of these devices are often preceded by a perforator, e.g. a perforator according to DE 43 38 561 A1 or U.S. Pat. No. 5,642,661 A.

So that the technical effort and expenditure in the case of these devices can be reduced, devices are also known in which means for perforation are provided on pressing parts of the pressing device(s), e.g. in the case of a device for compacting empty beverage containers according to DE 100 55 201 A1. This device possesses a conveyor segment that essentially narrows in funnel shape, into which the beverage containers run and are successively compacted under the effect of the devices for transport and compression that delimit the conveyor segment on the sides.

Furthermore, it is provided there that the rollers are equipped with blade-shaped elevations distributed on their circumference, which extend over the length of the rollers, in other words parallel to their axis of rotation. Furthermore and in particular, in the case of this device, the devices for transporting and compacting the beverage containers consist of rollers driven by drum motors.

This device is expensive and maintenance-intensive, particularly because of the modules last mentioned.

Also, devices are known in which the distance between the rollers disposed in pairs, particularly those with the least distance between axles, is adjustable, particularly with regard to the distance between them and the position of the blades that are directed longitudinally, in such a manner that separation of the material passed through takes place, in the manner of breaking, tearing, or shearing, so that several smaller pieces are formed from a bottle or can, in each instance.

What type of volume reduction of the said empty containers—whether compaction or comminution—takes place at the acceptance location of the waste goods, results from the task(s) performed during the subsequent recycling states, the transport to the recycling company, and the recycling method itself. A device for comminuting the said waste goods can therefore be set up at the return site or at the recycling company.

Known devices for comminuting the said waste goods have the disadvantage, among others, that the breaking, tearing, or shearing edges on the small and tiny pieces produced are frayed, for one thing, and/or that so-called white breaks are present in these pieces—the so-called flakes. These frayed edges or white breaks represent a quality defect in the classification of the recycling material, for further processing.

Another disadvantage of known devices for comminuting the said waste material also consists in the fact that the individual pieces produced can still contain fragments of the labeling provided on the said containers, e.g. PET bottles (coding for the deposit bottle return system), and therefore misuse cannot be precluded.

Proceeding from this state of the art, a person skilled in the art is confronted with the task of configuring a device for comminuting empty containers, particularly beverage bottles and/or beverage cans, respectively, made of plastic, particularly PET bottles, or tin plate, respectively, in such a manner that the comminution is guaranteed reliably and in high quality, and that the production costs and the maintenance expenditure for this device are low, as compared with known devices.

According to the invention, this task is accomplished by means of a device for comminuting empty containers, having the characteristics of claim 1; advantageous further developments of the invention are the object of the dependent claims.

The core idea of the invention consists in the fact that in the case of the new device for comminution, the said waste goods are cut into pieces with only one pair of cutting rollers, whereby a cutting unit used in the case of document shredders, for shredding paper or paperboard, is disposed in the device for comminution according to the invention. This cutting unit consists of a cutting mechanism having two cutting rollers, the axes of rotation of which are disposed parallel to and at a distance from one another. This cutting unit furthermore includes a gear mechanism, a drive, and a control unit. Each of the two cutting rollers has several cutting disks, which are disposed spaced apart from one another by means of a recess (gap), in each instance, viewed in the axial direction. The distance between the axes of rotation, relative to one another, is chosen in such a manner that the cutting disks of the cutting roller that lies opposite dip into the gap of the other cutting roller. The axial distance from one cutting disk to the next cutting disk on a cutting roller, in other words the width of the gap (recess), is greater than the width of a cutting blade of the opposite cutting roller. In this way, the result is achieved that a gap having a slight width is present between the side flanks, which face one another, of the related overlapping (meshing) cutting disks, the so-called cutting play. By means of an appropriate adjustment, axial displacement, the cutting play can be adjusted in such a manner that no gap or a very narrow gap is present on the one side of the cutting disk in question, and the cutting play between the two side flanks that face one another is greater on the other side of the cutting disk. The size/width of the cutting play between two side flanks, which face one another, of two adjacent cutting disks, in each instance, is selected in accordance with the planned application. Thus, this cutting play is different for PET containers than for containers made of tin plate. The wall thickness of the containers can also be taken into consideration for adjusting the cutting play, as can the use of a device for waste goods made of different materials. A further development of the device therefore provides that at least one cutting roller is disposed to be adjustable and lockable in the axial direction.

The new device for comminuting empty containers, particularly beverage bottles or cans made of plastic or tin plate, consists of a housing/frame that has a fill-in opening, as well as an exit opening (outlet opening), and a cutting unit disposed on the housing, which stands in front. Furthermore, to the extent that they are provided, means for activating and controlling one or more closing elements for the fill-in opening and/or the exit opening are disposed on and/or in the device.

Specifically, it is provided on the cutting unit that at least one, preferably several clearances (grooves), particularly four or a multiple of two, are worked into the circumference surface of the cutting disks on at least one of the cutting rollers, but preferably on both cutting rollers. These clearances break through at least one of the two cutting disk flanks of the cutting disks, preferably both cutting disk flanks.

The diameter of the cutting rollers lies in the range of 50 to 200 mm; preferably it amounts to 80 mm +/−10%. According to another embodiment, the diameters of the two cutting rollers are different.

A further development provides that strippers are disposed between the cutting disks, whereby preferably, standard strippers of cutting mechanisms of document shredders are used.

The so-called cutting play between adjacent disks preferably has a value between 0.005 mm and 2 mm. The overlap of adjacent and opposite disks is selected to be between 0.5 mm and 15 mm.

The cutting rollers of the device preferably consist of the material 42CrMoS4. The cutting disks of the cutting rollers are hardened; in a preferred embodiment, only the body edge region is hardened.

According to a special further development of the grooves disposed in the circumference surface of the cutting disk(s), the trailing groove flank, in the direction of rotation, together with the circumference surface, forms a cutting tooth having an acute angle, which points in the direction of rotation, whereby the groove flank that begins at the tip of this tooth has a linear progression as well as a progression directed counter to the direction of rotation of the roller, at least in certain segments, and the subsequent transition region to the groove base and/or the leading groove flank, in the direction of rotation, is configured in arc shape. Preferably, the two groove flanks run parallel to one another or diverging from one another. The tip angle of each cutting tooth is preferably selected to be between 45° and 80°.

Furthermore, it is advantageously provided that the cutting rollers rotate in a speed of revolution range of 30 to 150 rpm. The drive of the cutting unit preferably has a power of 1.5 to 2 kilowatts. It is furthermore provided that the starting pulse for the cutting rollers takes place by way of a photo eye, for example, and that an after-running time is provided.

Other advantageous design details in the case of the new device are the bearings for the cutting rollers, which are set into the bearing plates from the outside. This is advantageous because it cannot be precluded that containers fed in are closed and furthermore still contain liquid, which in turn can ferment, so that pressure is built up in the bottle, and this liquid sprays about in the cutting unit, in uncontrolled manner, when the first perforation occurs.

Because of the latter, nozzles are provided in the housing of the device, to apply disinfectant to the cutting rollers and/or the inlet opening and the outlet opening.

The external dimensions of the device are such that coupling to automated bottle and/or can return machines or systems can take place. The device is particularly designed for containers having a volume of 0.2 to 3 liters.

Furthermore, in the case of the new device, it is provided that a separator precedes the cutting mechanism in the region of the fill-in opening, which comprises a supply container having a funnel-like shape, in the preferred embodiment. Vanes, preferably three or four vanes, rotate about an axle of rotation and feed the waste goods, in the transport direction, to the cutting mechanism in orderly manner and, at the same time, at least until the containers are seized by the cutting disks, press the waste goods into the intake gap of the cutting mechanism. Above the cutting mechanism and behind the separator, one of the walls of the funnel is continued, or a plate-like part is disposed, to delimit the supply space and as a guide surface for the return of any containers that might be dragged through underneath or with the vanes, back to the supply space.

Another special further development provides that the grooves in the cutting disks of each cutting roller, seen in the axial direction, are disposed so as to run in spiral shape. Furthermore, the peripheral cross-section of the cutting disks is configured to be beveled on one side or to run in V shape or arc shape towards the inside of the body. Furthermore, the spiral grooves are worked in deeper here than the depth of the bevels or groovings that are directed inward. This configuration has the result, for one thing, that the waste goods are better seized and drawn in by the cutting rollers and, for another, that the cut edges of the small pieces (flakes) produced are smooth. This configuration also has a positive effect with regard to the required power of the drive during the cutting process. Because of the smooth and clean cut edges, the flakes are also essentially prevented from hooking together or piling on top of one another.

Figure 2:
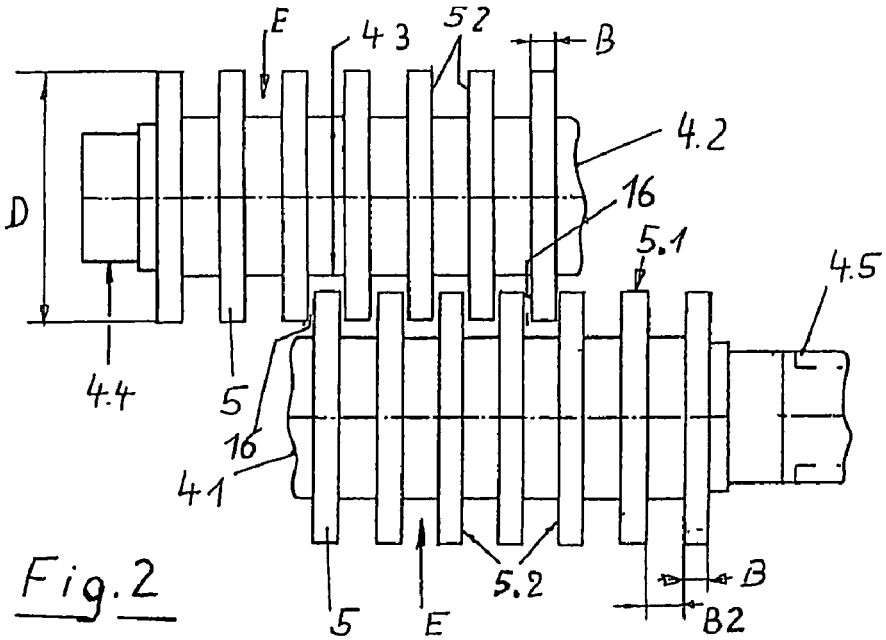
Figure 3:
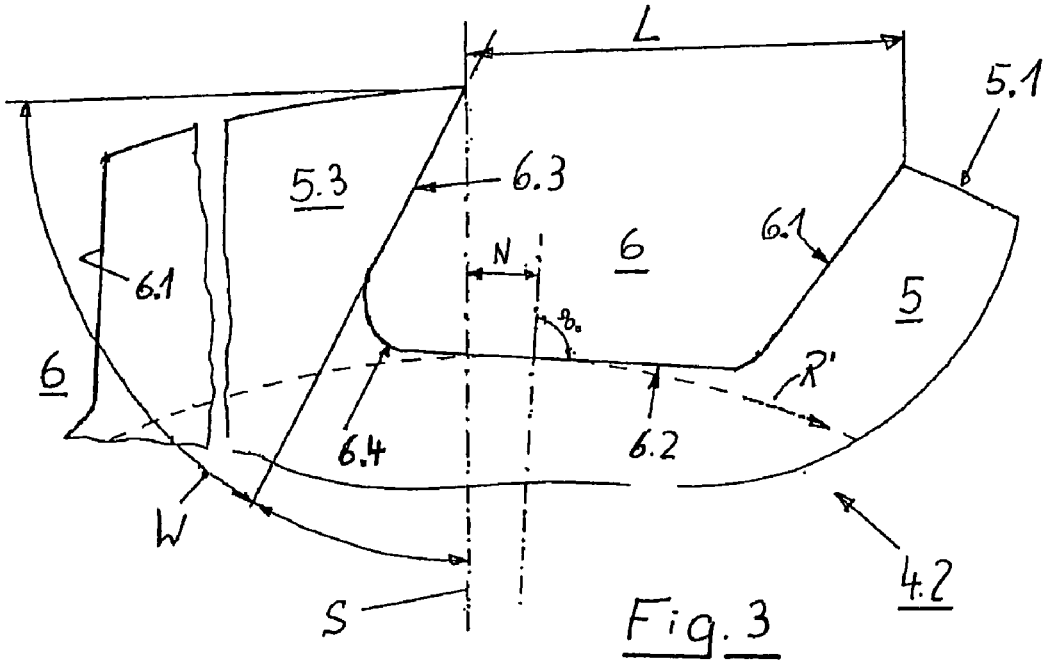
Figure 4:
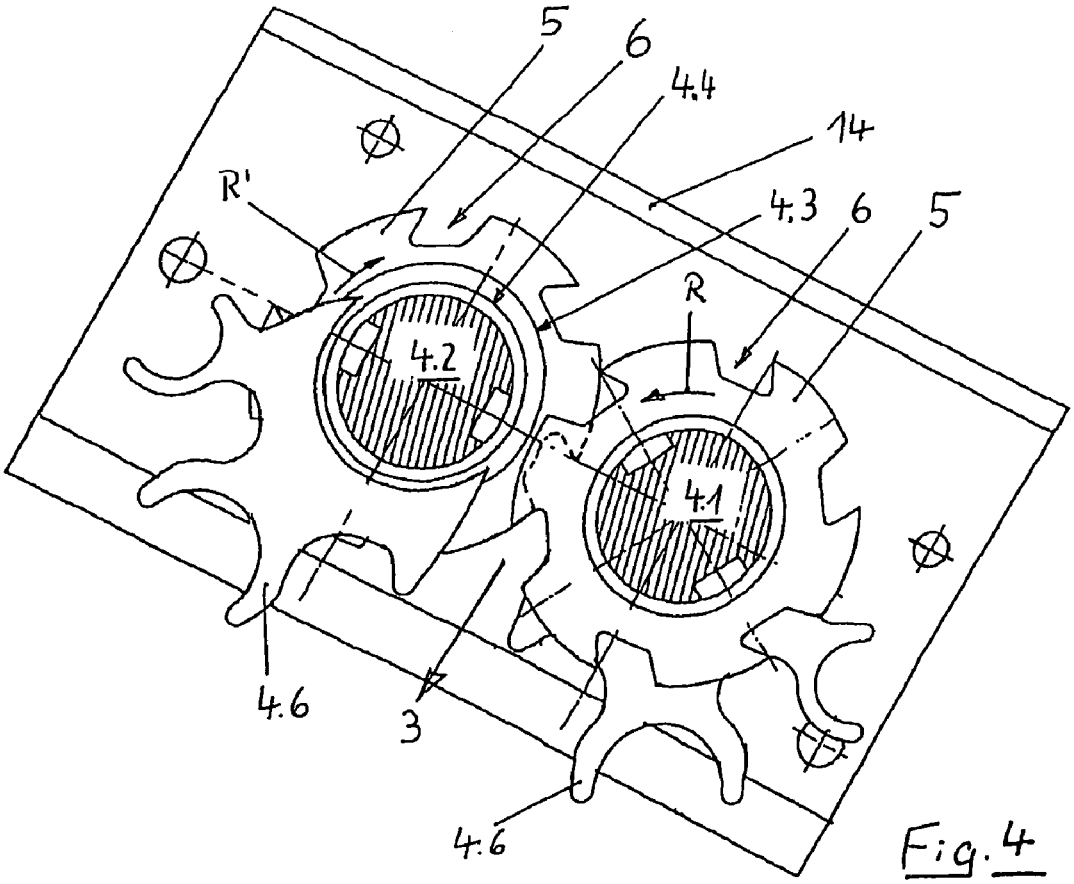
Figure 5:
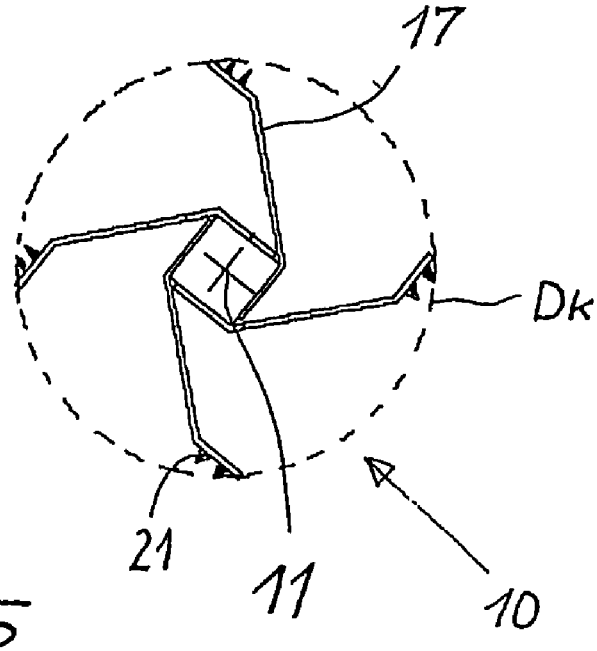
Figure 6:
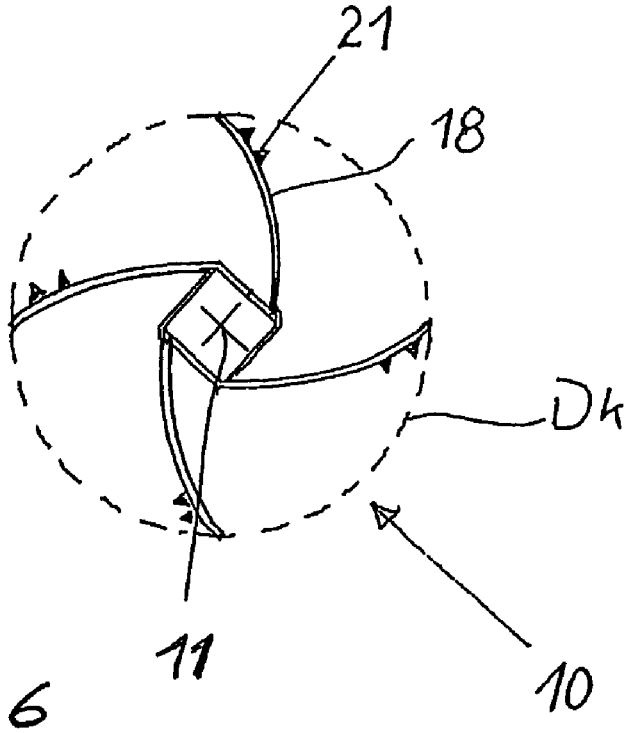

In the following description part, the invention will be explained in greater detail, using an advantageous exemplary embodiment shown schematically in drawings. These show:

FIG. 1 a device according to the invention, in a side view, having an open side surface and a view of the cutting unit, FIG. 2 a schematic view from the top, of the meshing cutting rollers, without bearing plates and without drive, FIG. 3 a detail of a cutting disk, FIG. 4 the cutting rollers in a side view, with the bearing plate removed on one side, and FIGS. 5 and 6 variants of the vanes of the metering and contact pressure shaft shown in FIG. 1.

The new device for comminuting empty containers is shown schematically in FIG. 1, in a side view, with the side surface partly open, and a view of the cutting unit. The device 20 comprises a housing 1, having a fill-in opening 2 in the upper side/surface 1.1, as well as an exit opening 3, also called outlet opening, in the lower side 1.3, and a cutting unit 4 disposed in the housing 1, as well as means for drive 7 and control 8 of the cutting unit 4. The front side 1.2 and the rear side 1.4 of the housing 1 are closed in the exemplary embodiment here.

The cutting unit 4 contains two cutting rollers 4.1 and 4.2, disposed at a distance from one another with regard to their axes of rotation. Each cutting roller 4.1 and 4.2 has at least two cutting disks 5, seen in the longitudinal direction of its axis of rotation A1 and A2, respectively, whereby these cutting disks 5 are spaced apart by means of a recess E that is directed radially inward, reaching to a core diameter 4.3—see FIG. 2 in this regard. B2 refers to the width of each recess E. This width B2 is greater than the width B of the cutting disks 5. Therefore a so-called cutting play 16 exists between the meshing segments of the cutting disks 5, in other words between the cutting disk flanks 5.2 that face one another there. Preferably, the value for this cutting play 16 is selected in a range between 0.005 mm and 2 mm. In the case of this exemplary embodiment, it is provided, in a special configuration, that the cutting roller 4.2 is mounted so that it can be adjusted and locked in the axial direction. The advantages that result from this have already been described in the front part of the specification.

The overlap of adjacent and opposite cutting disks can be selected in a value range between 0.5 mm and 15 mm, and preferably amounts to 6 to 8 mm in the exemplary embodiment.

In the circumference surface 5.1 of each cutting disk 5, at least one groove 6—clearance—is provided, in each instance, in the exemplary embodiment preferably six grooves 6. The grooves 6 in the opposite cutting roller 4.1 or 4.2, in each instance, are disposed in a mirror image of the ones in the other cutting roller.

In the upper surface 1.1, a fill-in opening 2 is provided, which forms a supply container 2' with the inclusion of the walls 9 and 13. This supply container 2' leads to the intake gap formed by the cutting rollers 4.1 and 4.2. A separator/selector 10 is disposed in the close vicinity of this intake gap in the supply container 2'. Vanes 12 are disposed on an axle of rotation 11 of this separator. Containers (waste goods 19) that are being fed in are passed to the intake gap of the cutting mechanism by means of rotation of these vanes 12. In accordance with the total width of the cutting mechanism, one or more containers 19 are fed in. The distance of the axle of rotation 11 from the cutting rollers, and the position and shape of the vanes 12, is selected in such a manner that the said containers 19 are pressed into the intake gap of the cutting mechanism by means of the end regions of the vanes 12. If, nevertheless and contrary to expectations, a container were to slip through under a vane, or not be seized by the cutting rollers, the rear wall of the supply container 2', the wall 13, is disposed in such a manner that such containers are transported back into the supply container 2'.

The containers 19 that are fed in are seized by the cutting disks 5, particularly by means of the cutting teeth 5.3, and drawn into the cutting gap, and cut into so-called particles 15 by means of the cutting disks. The small pieces that are produced are then output through the outlet opening 3. A collection container can be disposed below this outlet opening, or the cut goods fall onto a transport belt and are transported to a collection container. The housing/frame 1 of the device roller is dimensioned in such a manner that it can be coupled onto an automated bottle and/or can return machine, or integrated into same.

The cutting disks 5 of the cutting rollers 4.1 and 4.2 are preferably surface-hardened. The end region of the cutting roller 4.2 that is on the left in FIG. 2 is shaped as a bearing journal 4.4, and the end region of the cutting roller 4.1 that is on the right in the figure is shaped as a bearing and drive journal 4.5.

In the case of the embodiment shown in FIGS. 1, 2, and 4, the bearings of the cutting rollers 4.1 and 4.2 are set into bearing plates 14 disposed in the housing, from the outside. In this regard, as well, the advantages have already been stated in the front part of the specification.

The diameter D of the cutting disks 5 is preferably 79 mm in the case of this exemplary embodiment, a device for comminuting PET bottles having a volume of 0.25 to 3 liters.

The speed of rotation of the cutting rollers 4.1 and 4.2 of the cutting unit 4 is preferably 50 to 90 rpm here. The starting pulse for the cutting rollers 4.1 and 4.2 preferably takes place by way of a photo eye, which is not shown here; furthermore, an after-running time is provided.

FIG. 4 furthermore shows that in the case of this embodiment, strippers 4.6 are disposed between the cutting disks 5, whereby standard strippers of document shredders are used.

Not shown are nozzles disposed in the housing 1, to apply disinfectant and/or cleaner to the cutting rollers 1.4 and 1.2 and/or to the fill-in opening 2 and the outlet opening 3, so that odor formation (bacteria formation) promoted by residues of liquid and the ambient atmosphere can be prevented.

FIG. 3 shows the detailed configuration of the groove 6 in the cutting disk 5. According to FIG. 3, each trailing flank 6.3, in the direction of rotation R', of the grooves 6 disposed in the circumference surface 5.1 of the cutting disks 5 of the cutting roller 4.2, forms a cutting tooth 5.3, together with the circumference surface 5.1, which tooth has an acute angle and points in the direction of rotation, whereby the groove flank 6.3, which begins at the tip, has a linear progression as well as a progression directed counter to the direction of rotation R' of the cutting roller, and the subsequent transition region 6.4 to the groove base 6.2 and/or the groove flank 6.1 that lies in the direction of rotation is configured in arc shape. Preferably, the two groove flanks 6.1 and 6.3 run parallel to one another or diverging from one another. The tip angle W of the cutting teeth 5.3 is preferably selected to be between 45° and 80°, in the exemplary embodiment shown it is preferably 60°. N refers to an incline angle that is formed between the vertical line S of the imaginary axis intersection that runs through the axis of rotation A2, and the vertical line that stands on the groove base 6.2, which is also laid through the axis of rotation A2. L refers to the length of the groove 6. Preferably, this length L, in this embodiment, corresponds to approximately 40% of the length of the arc that is defined by a groove 6 and a segment of the circumference surface 5.1 of a cutting disk 5 that follows same.

Further variants of the vanes of the separator shown in FIG. 1 are shown in FIGS. 5 and 6. Proceeding from the center, the axle of rotation 11, these vanes are shaped in polygon manner 17 or in arc shape 18, towards their free ends. The circumference circle described by the ends of the moving vanes is designated as Dk. These embodiments guarantee that containers having a volume of 0.25 liter to 3 liters are given optimal contact pressure in the direction of the intake gap of the cutting mechanism. As is also evident from the two figures, the end regions of the vanes 17 and 18, respectively, are fitted with stabbing elements 21. The tip of these stabbing elements points in the direction of rotation, in other words in the working direction. By means of this measure, holding and guiding the containers to the intake gap of the cutting mechanism is further improved. Particularly in the case of containers that have very thin walls and are very flexible, it can happen, under some circumstances, that the vane ends could slip over such a container. These stabbing elements counteract such a possibility.

All of the characteristics mentioned in the above description as well as those that can only be derived from the drawing are additional integral parts of the invention, even if they are not particularly emphasized and especially not mentioned in the claims.

The invention is not restricted to the exemplary embodiment described, but rather is variable in many different ways, within the scope of the disclosure.

Thus it lies within the scope of the invention to position the fill-in opening 2 in one of the side walls of the housing 1 instead of in the upper surface 1.1. The aforementioned change in the position of the fill-in opening can be implemented without any great additional technical effort, because of the use of a cutting mechanism of a document shredder, which is available in a compact construction, as provided.

Reference Symbol List

| | |
|---|---|
| 1 | housing |
| 1.1 | upper side (surface) |
| 1.2 | front side |
| 1.3 | lower side |
| 1.4 | rear side |
| 2 | fill-in opening |
| 2' | supply container |
| 3 | outlet opening (exit opening) |
| 4 | cutting unit |
| 4.1 | first cutting roller (front) |
| 4.2 | second cutting roller (rear) |
| 4.3 | core diameter |
| 4.4 | bearing journal |
| 4.5 | bearing and drive journal |
| 4.6 | stripper |
| 5 | cutting disks |
| 5.1 | circumference surfaces |
| 5.2 | cutting disk flanks |
| 5.3 | cutting teeth |
| 6 | grooves |
| 6.1 | leading groove flank |
| 6.2 | groove base |
| 6.3 | trailing groove flank |
| 6.4 | transition region |
| 7 | drive |
| 8 | control unit |
| 9 | wall of item 2' |
| 10 | separator |
| 11 | axle of rotation of item 10 |
| 12 | vane |
| 13 | wall of item 2' (delimitation towards rear) |
| 14 | bearing plate |
| 15 | cut containers |
| 16 | cutting play |
| 17 | vanes, in the manner of a polygon |
| 18 | vanes, arc-shaped |
| 19 | waste goods (container, vessel) |
| 20 | device |
| 21 | stabbing elements (sharp screws, nails, and the like) |
| A1 | axis of rotation of the cutting roller 4.1 |
| A1 | axis of rotation of the cutting roller 4.2 |
| B | width of item 5 |
| B2 | width of the recesses |
| D | diameter of item 5 |
| Dk | circumference circle of the vanes of item 10 |
| E | recesses |
| L | length of item 6 |
| N | incline angle |
| W | tip angle |
| S | vertical line to item A2 |
| R | direction of rotation |
| R' | direction of rotation |

The invention claimed is:

1. Device for comminuting empty containers selected from the group consisting of beverage bottles and beverage cans made of plastic/PET or tin plate, comprising a housing/frame (1), having a fill-in opening (2), as well as an exit opening (3), and a cutting unit (4) disposed in the housing (1), as well as means for drive and control of the cutting unit (4), whereby the cutting unit (4) contains at least cutting rollers (4.1 and 4.2), disposed at a distance from one another with regard to their axes of rotation, wherein the cutting unit (4) is a cutting unit (4) used for shredding paper or paperboard in document shredders, in which each cutting roller (4.1 and 4.2) has multiple cutting disks (5), which are each disposed at an axial distance from one another by means of a circumferential groove (gap E), and the axes of rotation (A1 and A2) of the cutting rollers (4.1 and 4.2) are disposed at an axial distance from one another, in such a manner that adjacent cutting disks (5) of the two cutting rollers (4.1 and 4.2) mesh, whereby a gap, the cutting play (16), is present between two side flanks (5.2) of adjacent cutting disks (5), which flanks face one another, in each instance;

wherein the cutting mechanism is a particle cut cutting mechanism and wherein the cutting disks (5) have grooves (6) worked into their circumference surface (5.1), whose trailing flank (6.3), in the direction of rotation (R, R'), forms a cutting tooth (5.3), together with the circumference surface (5.1), which tooth has an acute angle and points in the direction of rotation, whereby the groove flank (6.3), which begins at the tip, has a linear progression as well as a progression directed counter to the direction of rotation (R, R'), and the subsequent transition region (6.4) to the groove base (6.2) and/or the groove flank (6.1) that lies in the direction of rotation is configured in arc shape.

2. Device according to claim 1, wherein a separator/selector (10) is disposed ahead of the cutting mechanism and wherein the separator/selector (10) is a vane shaft that possesses three or four vanes (12), the free vane ends of which trail, seen in the direction of rotation (R').

3. Device according to claim 2, wherein the vanes attached in the center, i.e. on the axle of rotation, are configured in polygon manner (17) or in arc shape (18) towards their free ends.

4. Device according to claim 3, wherein the separator/selector (10) is disposed ahead of the cutting mechanism, the separator/selector comprising two star-shaped shafts, seen in a face side view.

5. Device according to claim 1, wherein the so-called cutting play (16) between adjacent cutting disks (5) of the cutting mechanism has a value between 0.005 mm and 2 mm.

6. Device according to claim 1, wherein the overlap of adjacent and opposite cutting disks (5) has a value between 0.5 mm and 15 mm.

7. Device according to claim 1, wherein the cutting rollers comprise the material 42CrMoS4.

8. Device according to claim 1, wherein the cutting disks (5) of the cutting rollers (4.1 and 4.2) are hardened.

9. Device according to claim 1, wherein the bearings of the cutting rollers (4.1 and 4.2) are set into their bearing plates (14) from the outside.

10. Device according to claim 1, wherein the diameter (D) of the cutting disks (5) lies in the range of 50 to 200 mm.

11. Device according to claim 1, wherein the drive (7) of the cutting rollers (4.1 and 4.2) is designed for speeds of rotation in the range of 30 to 150 rpm.

12. Device according to claim 1, wherein strippers (4.6) are disposed between the cutting disks (5), whereby each stripper (4.6) only partially surrounds the cutting rollers (4.1 and 4.2, respectively) at their core diameter (4.3), in each instance, in the circumferential groove (E).

13. Device according to claim 1, wherein a photo eye is disposed in the region of the fill-in opening (2), to generate a starting pulse for the cutting rollers (4.1 and 4.2).

14. Device according to claim 1, wherein nozzles are disposed in the housing (1), to apply disinfectant to the cutting rollers (4.1 and 4.2) and/or the fill-in opening (2) and the outlet opening (3).

15. Device according to claim 1, wherein the two groove flanks (6.1 and 6.3) run parallel to one another or diverge from one another.

16. Device according to claim 1, wherein the tip angle (W) of a cutting tooth (5.3) lies between 45° and 80°.

17. Device according to claim 1, wherein the arc defined by a groove (6) and a segment of the circumference surface (5.1) of a cutting disk (5) that follows same (6) is determined, by 40%, by the groove (6)

18. Device according to claim 1, wherein the device can be coupled to automated bottle and/or can return machines or integrated into same.

19. Device for comminuting empty containers selected from the group consisting of beverage bottle and beverage cans made of plastic/PET or tin plate, comprising a housing/frame (1), having a fill-in opening (2), as well as an exit opening (3), and a cutting unit (4) disposed in the housing (1), as well as means for drive and control of the cutting unit (4)

whereby the cutting unit (4) contains at least cutting rollers (4.1 and 4.2), disposed at a distance from one another with regard to their axes of rotation, wherein the cutting unit (4) is a cutting unit (4) used for shredding paper or paperboard in document shredders, in which each cutting roller (4.1 and 4.2) has multiple cutting disks (5), which are each disposed at an axial distance from one another by means of a circumferential groove (gap E), and the axes of rotation (A1 and A2) of the cutting rollers (4.1 and 4.2) are disposed at an axial distance from one another, in such a manner that adjacent cutting disks (5) of the two cutting rollers (4.1 and 4.2) mesh, whereby a gap, the cutting play (16), is present between two side flanks (5.2) of adjacent cutting disks (5), which flanks face one another, in each instance;

wherein a separator/selector (10) is disposed ahead of the cutting mechanism;

wherein the separator/selector (10) is a vane shaft that possesses three or four vanes (12) , the free vane ends of which trail, seen in the direction of rotation R'); and wherein stabbing elements (21) that point in the direction of rotation (R') are disposed on the surface segments of the separator (10) that contact the fed-in containers part of the time.

* * * * *

UNITED STATES PATENT AND TRADEMARK OFFICE

CERTIFICATE OF CORRECTION

PATENT NO. : 7,556,213 B2
APPLICATION NO. : 10/579272
DATED : July 7, 2009
INVENTOR(S) : Schwelling It is certified that error appears in the above-identified patent and that said Letters Patent is hereby corrected as shown below:

In particular, in Column 8, line 37, (Line 1 of Claim 4) please change "claim 3" to correctly read:

--claim 2--.

Signed and Sealed this

Twenty-fifth Day of August, 2009

David J. Kappos

David J. Kappos
*Director of the United States Patent and Trademark Office*